US007887137B2

(12) United States Patent
Fisher et al.

(10) Patent No.: US 7,887,137 B2
(45) **Date of Patent: *Feb. 15, 2011**

(54) THEATRE CHAIR

(75) Inventors: David John Fisher, Wantima South (AU); Adam William Fisher, Wantima South (AU)

(73) Assignee: Camatic Pty. Ltd., Wantima South (AU)

( * ) Notice: Subject to any disclaimer, the term of this patent is extended or adjusted under 35 U.S.C. 154(b) by 0 days.

This patent is subject to a terminal disclaimer.

(21) Appl. No.: 12/506,867

(22) Filed: Jul. 21, 2009

(65) Prior Publication Data

US 2009/0322140 A1 Dec. 31, 2009

Related U.S. Application Data

(60) Continuation-in-part of application No. 12/201,583, filed on Aug. 29, 2008, now abandoned, which is a division of application No. 10/220,751, filed as application No. PCT/AU01/00232 on Mar. 2, 2001, now Pat. No. 7,419,221.

(30) Foreign Application Priority Data

Mar. 2, 2000 (AU) ..... PQ 5975

(51) Int. Cl.
*A47C 4/02* (2006.01)

(52) U.S. Cl. ..... 297/440.2; 297/440.22

(58) Field of Classification Search ..... 297/219.1, 297/228.13, 440.2, 440.22, 452.18, 452.55
See application file for complete search history.

(56) References Cited

U.S. PATENT DOCUMENTS

| | | | | |
|---|---|---|---|---|
| 1,232,931 | A | 7/1917 | Kilburn | |
| 1,251,976 | A | 1/1918 | Ledwinka | |
| 1,810,888 | A | 6/1931 | Hanson | |
| 3,171,685 | A * | 3/1965 | Hershberger et al. | 297/92 |
| 3,427,069 | A | 2/1969 | McDonald | |
| 3,669,497 | A | 6/1972 | Massonnet | |

(Continued)

FOREIGN PATENT DOCUMENTS

JP 8-173273 A 7/1996

(Continued)

*Primary Examiner*—Peter R. Brown
(74) *Attorney, Agent, or Firm*—Drinker Biddle & Reath LLP

(57) ABSTRACT

A chair having a frame with one of a seat component and a backrest component, the seat component having a base member and a seat member while the backrest component include a base member and a backrest member where one of the seat and backrest component base member is connected to the frame. Complementary clip means on the one of the seat and backrest component base member allow the member to cooperate with the or each respective one of seat and backrest member, whereby either the respective seat member or backrest member can be clipped to the seat or backrest component base member. A toggle joint provides a snap over type connection effective when the one of the seat and backrest component base member and the one of the respective seat and backrest member are clipped together to cause one of the base member and the seat/backrest member to be in tension and the other member to be in compression when the two members of the component are clipped together.

24 Claims, 16 Drawing Sheets

U.S. PATENT DOCUMENTS

| | | | | | |
|---|---|---|---|---|---|
| 3,727,975 | A | | 4/1973 | Anderson | |
| 3,747,978 | A | | 7/1973 | Barecki | |
| 3,861,747 | A | | 1/1975 | Diamond | |
| 3,917,312 | A | * | 11/1975 | Rodaway | 280/250.1 |
| 4,126,354 | A | | 11/1978 | DeLong et al. | |
| 4,169,627 | A | | 10/1979 | Murphy et al. | |
| 4,332,419 | A | | 6/1982 | Vogel | |
| 4,750,783 | A | | 6/1988 | Irby et al. | |
| 4,768,825 | A | | 9/1988 | Quinlan | |
| 5,067,772 | A | | 11/1991 | Koa | |
| 5,074,620 | A | | 12/1991 | Jay et al. | |
| 5,135,284 | A | * | 8/1992 | Crum | 297/440.15 |
| 5,375,914 | A | | 12/1994 | Donnelly | |
| 5,899,531 | A | | 5/1999 | Koehler | |
| 5,947,562 | A | * | 9/1999 | Christofferson et al. | 297/440.22 |
| 6,062,649 | A | | 5/2000 | Nagel et al. | |
| 6,135,562 | A | | 10/2000 | Infanti | |
| 6,149,240 | A | | 11/2000 | Pietrzak | |
| 6,220,661 | B1 | | 4/2001 | Peterson | |
| 6,305,750 | B1 | | 10/2001 | Buono et al. | |
| 6,595,583 | B2 | * | 7/2003 | Hou | 297/130 |
| 7,066,549 | B2 | * | 6/2006 | Dennon et al. | 297/440.2 |
| 2003/0025372 | A1 | | 2/2003 | Conner et al. | |

FOREIGN PATENT DOCUMENTS

| | | |
|---|---|---|
| WO | WO 99/20155 A1 | 4/1999 |

* cited by examiner

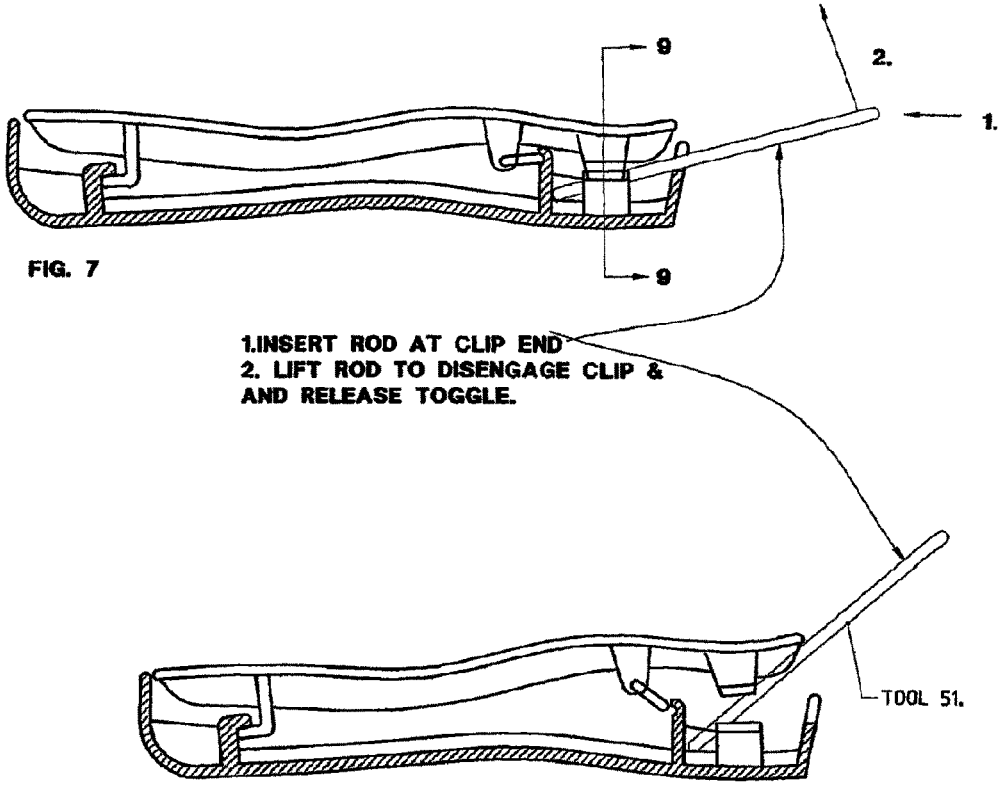
FIG. 7
FIG. 8
FIG. 9
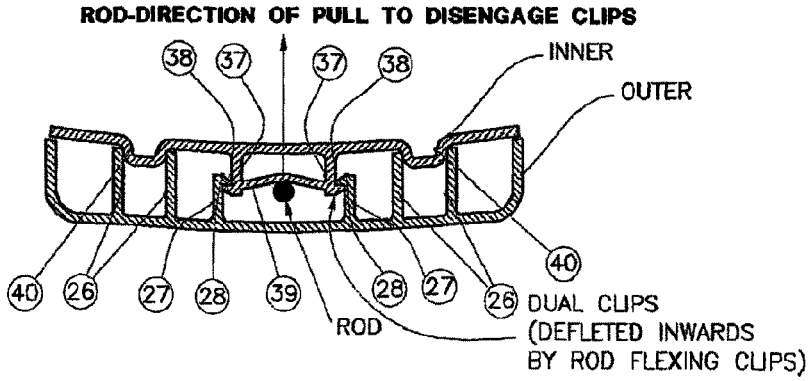

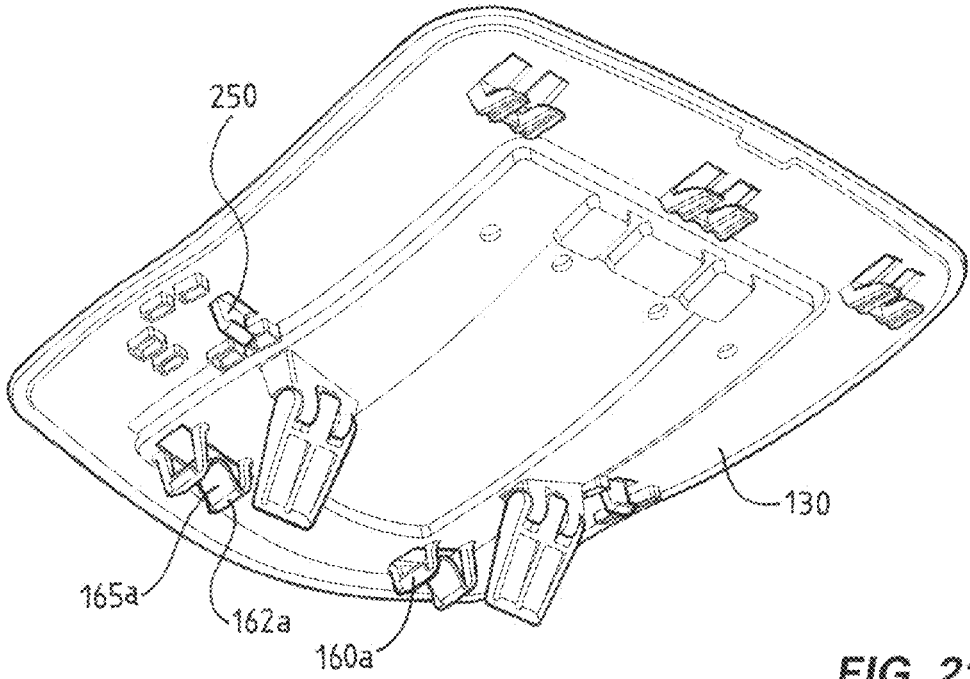
FIG. 21
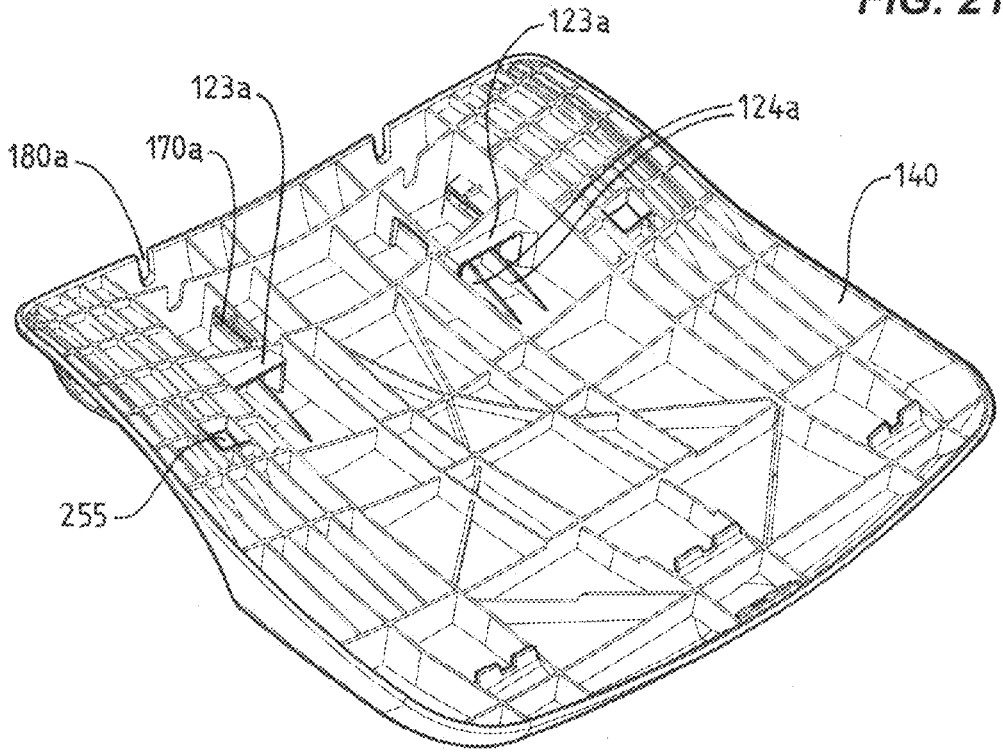

THEATRE CHAIR

CROSS-REFERENCE TO RELATED PATENT APPLICATIONS

This patent application is a continuation-in-part of copending U.S. patent application Ser. No. 12/201,583, filed Aug. 29, 2008, which is a divisional of copending U.S. patent application Ser. No. 10/220,751, filed Dec. 10, 2003, now U.S. Pat. No. 7,419,221, which is a national phase application of International Application No. PCT/AU01/00232, filed Mar. 2, 2001, which claims priority to Australian Patent Application No. PQ 5975, filed Mar. 2, 2000.

BACKGROUND OF THE INVENTION

This invention relates to seat and backrest components (e.g. cushions and upholstery) of chairs, particularly chairs for public venue or mass seating and is generally useful for chairs used in stadiums cinemas, auditoria, theatres and the like.

When a theatre (used by way of a non-limiting example) is built or refurbished it may be the case that the chairs must be installed before all other works or trades have been completed. The chairs may be installed and a protective plastic sheeting laid over them but damage to the seat and backrest components (that may have cushions, or upholstery) may still result, whether due to a particular incident or accident, or due to the general dust and debris of a work site.

Further, with theatre chairs generally, it is necessary to refurbish the chairs at intervals, which normally means removing the chairs from the theatre and, say, re-upholstering them and then returning them to the theatre, or at least removing structural components from the chair. Neither operation is very satisfactory.

Further, individual chairs in theatres can be damaged either inadvertently or by vandalism and it is then necessary to re-upholster or repair these chairs on an individual basis. It is then necessary to have a skilled person come to the theatre to remove and replace or repair an individual chair.

SUMMARY OF THE INVENTION

A first object of the present invention is to provide a chair, and components that may have cushions or upholstered portions for use on a chair, that can initially be installed in its required position without the upholstered portions (or cushions) thereon, so that likelihood of damage during construction is minimised, and yet the upholstered portions or cushions can be readily installed. Desirably it can readily have the cushions or upholstered portions removed and reinstalled, should be it be necessary for refurbishment, either to an individual chair or to the chairs generally.

A second object of the present invention is to provide a chair, and components that may have cushions or upholstered portions for a chair, of robust construction, so that when used it feels solid and robust to a user, yet is inexpensive and simple to install, maintain or refurbish.

A first aspect of the invention provides a chair comprised of:

a frame;

a seat component and/or a backrest component, the seat component having a base member and a seat member, the backrest component having a base member and a backrest member;

the or each seat and/or backrest component base member connected to said frame;

complementary clip means on the seat and/or backrest component base member to cooperate with the or each respective seat and/or backrest member, whereby the or each respective seat member and/or backrest member can be clipped to the seat and/or backrest component base member; and a toggle joint which provides a snap over type connection effective when the seat and/or backrest component base member and the or each respective seat and/or backrest member are clipped together to cause one of the base member and of the seat/backrest member to be in tension and the other member to be in compression when the two members of the component are clipped together.

Preferably said complementary clip means comprise:

a first set of spaced arms on the base member, said first set of spaced arms having shoulders thereon and a flexible web therebetween; and a second set of spaced arms on the seat or backrest member, said second set of spaced arms having complementary shoulders thereon, the shoulders of the first set of arms capable of being received by the complementary shoulders of the second set of arms whereby the base member and seat or backrest member can be clipped together and the flexible web is capable of being deformed so as to cause the first set of arms to move together to thereby release the shoulders of the first set of arms from the complementary shoulders of the second set of arms.

Preferably access means are provided to permit access to the web by a tool which can be used as a lever to effect the deformation of the web.

Preferably there are complementary lugs on the seat and/or backrest member and the or each respective base member whereby the two members can be initially located one relative to the other before the clipping is effected.

Preferably there are complementary ribs on the seat and/or backrest member and the or each respective base member, the complementary ribs engageable during the clipping operation to provide lateral stability of the component.

Preferably the seat and/or backrest member has an upholstered surface and includes an outer cover which can fit over the upholstered surface and extends therebeneath, the arrangement being such that the cover portion which extends therebeneath is located between the component base member and the seat and/or backrest member when assembled.

Preferably the outer cover has a drawstring about its periphery to effectively locate and hold the cover over the seat and/or backrest member.

A second aspect of the invention provides a chair having a support, and a seat component and/or a backrest component connected to the support, the component comprising:

a base connected to the support;

a detachable component member;

a brace arrangement comprising a brace base portion and a brace detachable component member portion;

a pivotally mounted first toggle plate and a respective first pivot point for receiving the free end of the first toggle plate, one of the base and the detachable member having the pivotally mounted first toggle plate and the other of the base and the detachable member having the first pivot point;

wherein the base and the detachable member may be releasably connected by arranging the brace base portion against the brace detachable component member portion and by operation of the first toggle plate to a snap over position, putting one of the base and the detachable member under tension and the other of the base and the detachable member under compression.

This makes the component have a solid feel, as the base and component member are positively connected. Any slack in the system is taken up and relative movement between the base and member is avoided.

Preferably the chair further comprises a clip for releasably attaching the detachable member to the base, the clip having a first clip portion and a complementary second clip portion for receiving the first clip portion, one of the base and the detachable member having the first clip portion and the other of the base and the detachable member having the second clip portion.

This provides increased security and tamper-proofing.

Preferably the detachable member has the first pivotally mounted toggle plate and the first toggle plate is operable to a snap over position by the act of releasably attaching the detachable member to the base with the clip means, putting the detachable member in compression and the base in tension.

This increases the ease of installation or re-installation of the chair as it may be achieved in a single action.

Preferably the chair further comprises a pivotally mounted second toggle plate and a respective second pivot point for receiving the free end of the second toggle plate, one of the base and the detachable member having the pivotally mounted second toggle plate and the other of the base and the detachable member having the second pivot point;

wherein the base and the detachable member may be releasably attached by the clip means and the second toggle plate is operable to a snap over position, said first and second toggle plates putting one of the base and the detachable member under tension and the other of the base and the detachable member under compression.

This enables slim-line components to be provided, as the snap over connection is split into two toggle plates, one provided at each side of the centreline of the component, allowing the centre area of the detachable component member to be concave.

Preferably the first clip portion comprises a pair of first clip portion arms with a flexible web therebetween; whereby deformation of the flexible web causes the first clip portion arms to move toward each other, thereby releasing the clip means to allow detaching of the detachable member from the base.

Preferably the second clip portion comprises a pair of second clip portion arms and each of the second clip portion arms has an inwardly directed shoulder and wherein each of the first clip portion arms has an outwardly directed shoulder, said inwardly and outwardly directed shoulders being engageable to releasably attach the first clip portion to the second clip portion.

Preferably the detachable member includes a pair of downwardly directed ribs, one downward rib extending along each side of the detachable member and wherein the base includes two pairs of upwardly directed ribs, one pair of upward ribs extending along each side of the base, wherein each downward rib is received between respective upward ribs when the base and detachable member are attached to each other.

This improves the lateral stability of the component, as well as providing a guide for alignment during installation.

Preferably the base includes a base lug having an upwardly and an inwardly directed portion and the detachable member includes a member lug having a downwardly and an outwardly directed portion, the member lug adapted to be received under the base lug.

Preferably the first and/or the second toggle plate is resilient.

Preferably the first toggle plate is spring mounted.

Preferably the chair further includes access means permitting access to the flexible web by a lever tool (but not by a users hands), wherein the lever tool may be used to deform the flexible web. This provides further increased security and tamper-proofing, as a tool is required.

Preferably the detachable member is upholstered with an outer layer that extends over at least a portion of each face of the member. Preferably the outer layer is a cover having a peripheral drawstring.

Preferably the support is a beam.

Another aspect of the invention provides a component for use in a chair the component comprising:

a base;

a detachable component member;

a brace arrangement comprising a brace base portion and a brace detachable component member portion;

a pivotally mounted first toggle plate and a respective first pivot point for receiving the free end of the first toggle plate, one of the base and the detachable member having the pivotally mounted first toggle plate and the other of the base and the detachable member having the first pivot point;

wherein the base and the detachable member may be releasably connected by arranging the brace base portion against the brace detachable component member portion and by operation of the first toggle plate to a snap over position, putting one of the base and the detachable member under tension and the other of the base and the detachable member under compression.

Preferably the component further comprises a clip for releasably attaching the detachable member to the base, the clip having a first clip portion and a complementary second clip portion for receiving the first clip portion, one of the base and the detachable member having the first clip portion and the other of the base and the detachable member having the second clip portion.

Another aspect of the invention provides a detachable component member for use in a chair the detachable member comprising:

a pivotally mounted toggle plate; and a first clip portion having a pair of first clip portion arms with a flexible web therebetween; whereby deformation of the flexible web causes the first clip portion arms to move toward each other, to thereby allow release of a clip means to allow detaching of the member from a base.

BRIEF DESCRIPTION OF THE DRAWINGS

Other features and advantages of one or more preferred embodiments of the present invention will be readily apparent to one of ordinary skill in the art from the following written description with reference to and, used in conjunction with, the accompanying drawings showing preferred embodiments of the invention, in which:

FIG. 7 is a side sectional view showing the first stage of disengagement;

FIG. 8 shows disengagement continuing;

FIG. 9 shows and end view of the situation of FIG. 7

FIG. 18A shows the component clipped together, with a lever tool inserted via an access hole, FIG. 18B shows the component members partially unclipping as the lever tool operates the clip and FIG. 18C shows the two component members unclipped from each other;

FIG. 19A shows a lever tool inserted ready to operate and disengage the engaged clip and FIG. 19B shows the lever tool activating the clip and disengagement of the clip;

FIG. 21 shows a perspective view of an alternative base and detachable member for a seat component;

FIG. 23A shows a lever tool inserted ready to operate and disengage the engaged clip and FIG. 23B shows the lever tool activating the clip and disengagement of the clip; FIG. 24A shows the engaged position and FIG. 24B shows the disengaged position.

DETAILED DESCRIPTION OF THE INVENTION

Figure 1:
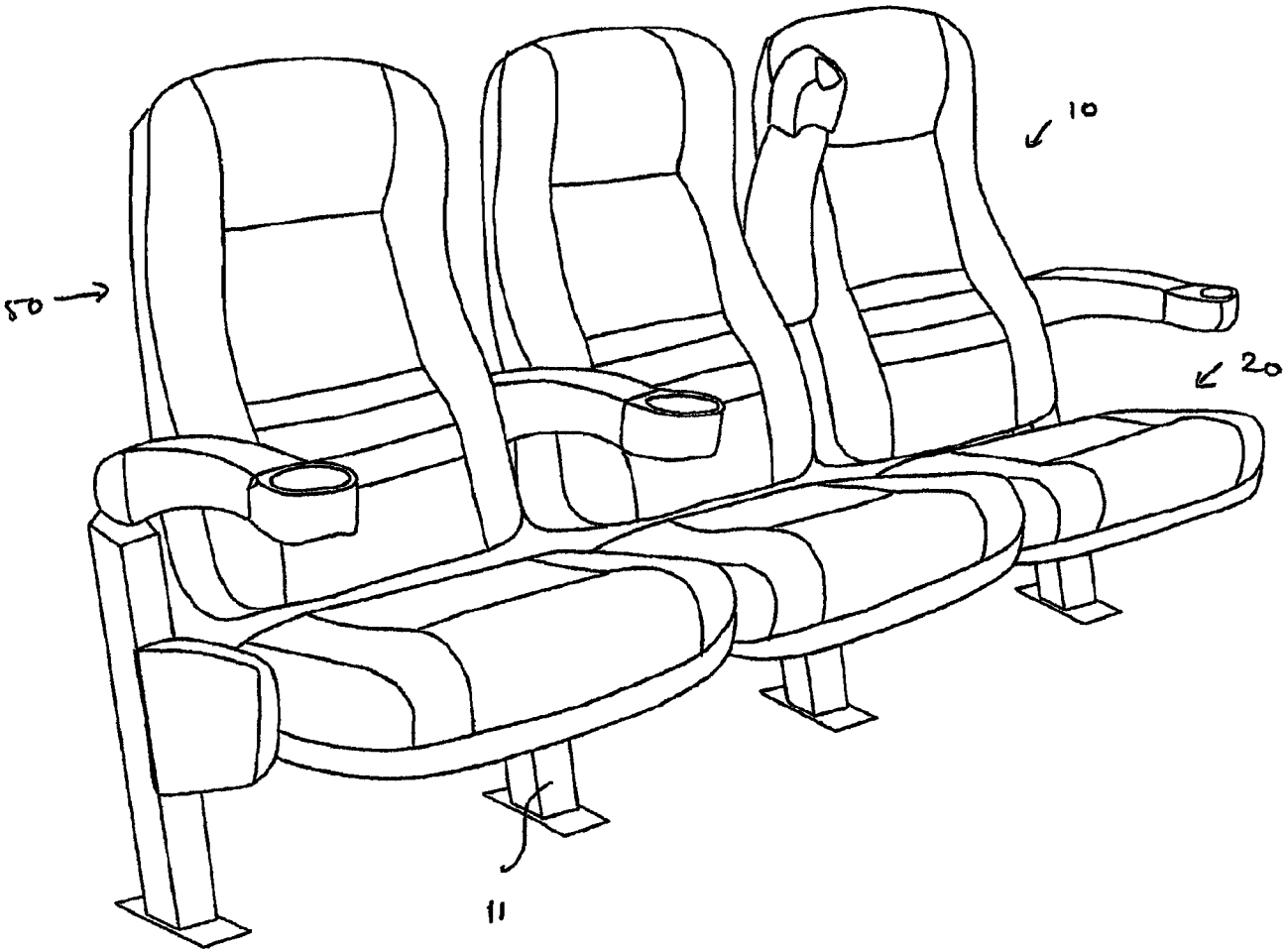
FIG. 1 is a perspective view of a chair according to one embodiment of the invention.
Figure 2:
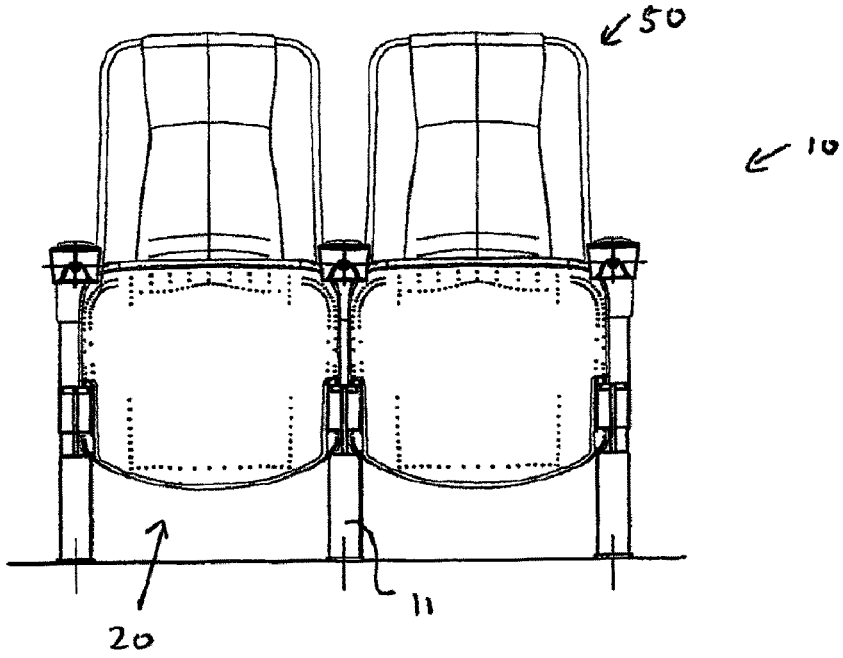
FIG. 2 is an elevation of the chair of FIG. 1.

A preferred embodiment of the chair 10 according to the present invention can have any general formation and has a frame 11 which is adapted to be permanently or semi-permanently connected to the floor of the venue. Either or both of a seat component 20 and a backrest component 50 may be connected to the frame 11 or partially integral therewith. FIGS. 1 and 2 show that the chair can look very similar to conventional theatre chairs.

The seat component may be adapted to be fixed relative to some part of the frame or may be rotatable thereabout to enable the seat to raise.

The components may preferably be of an engineering grade plastics material and be formed by injection moulding or could be formed in any other way.

Although, in exterior shape the seat component and the backrest component may differ substantially to suit a particular application or desired aesthetic, functionally either or both of the seat and backrest components on a given chair could be in accordance with the present invention. In this following, we shall refer only to one component but it is to be understood that either of the backrest or seat component may include the same features.

Figure 3:
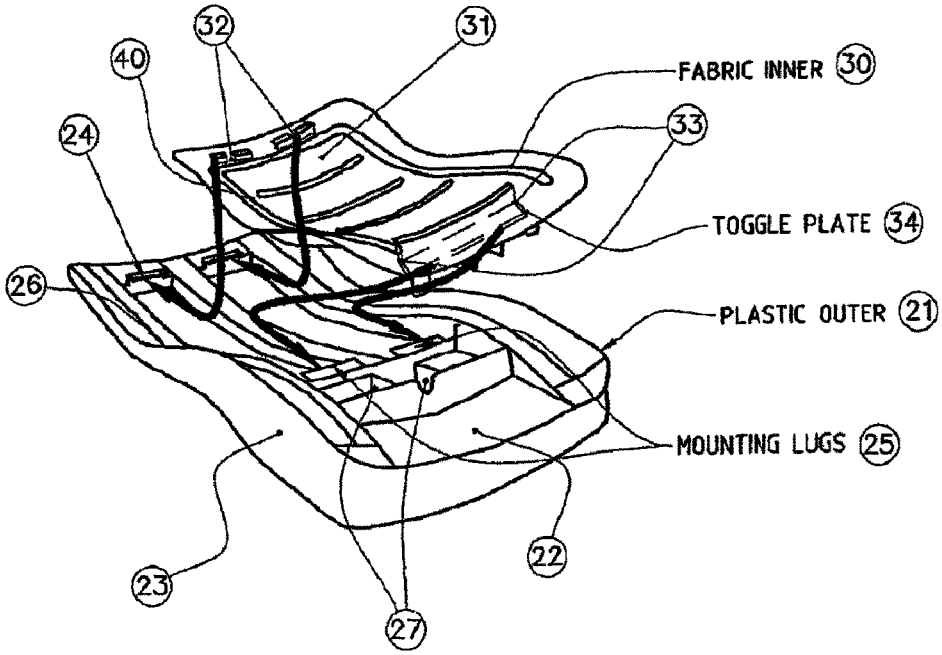
FIG. 3 is a view of seat components separated.

Referring to FIG. 3, in a preferred embodiment of the invention, the component has two sub-assemblies, a base 21 and an inner or member 30.

Figure 4:
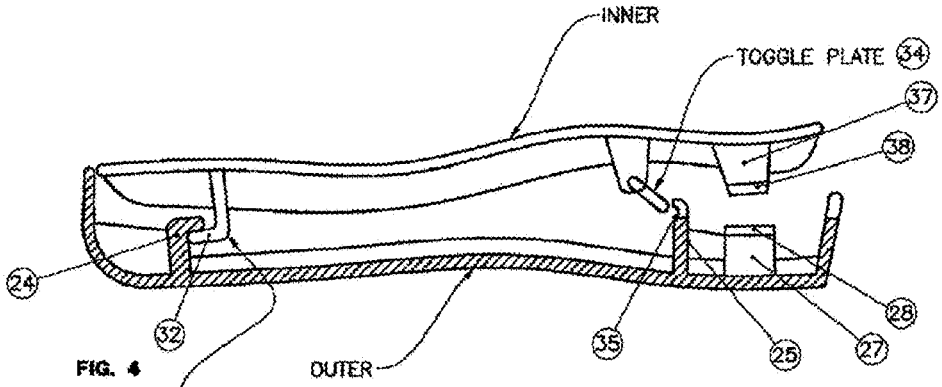
FIG. 4 is a side view of the components of FIG. 3 showing the components before inter engagement.

Viewing the component in the orientation shown in FIGS. 3 to 9, (but noting that in use these orientations will change depending on whether the component is a seat component or a backrest component, and that directional terms such as 'forward', 'rear', 'up' or 'down' are used for ease of reference but the invention is not limited thereby) the base 21 has a floor 22 which lies generally in a horizontal plane and the floor 22 has an upwardly directed peripheral skirt 23 which (unlike FIG. 3) in FIG. 4 is shown to extend around both the front and rear ends of the base.

Figure 10:
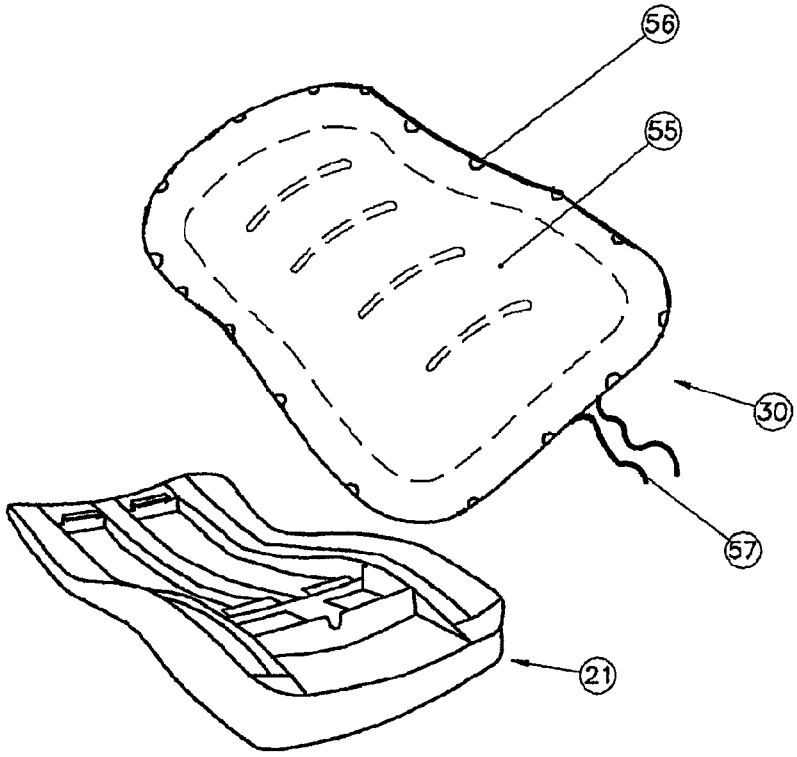
FIG. 10 shows the method of replacing an upholstery envelope.
Figure 11:
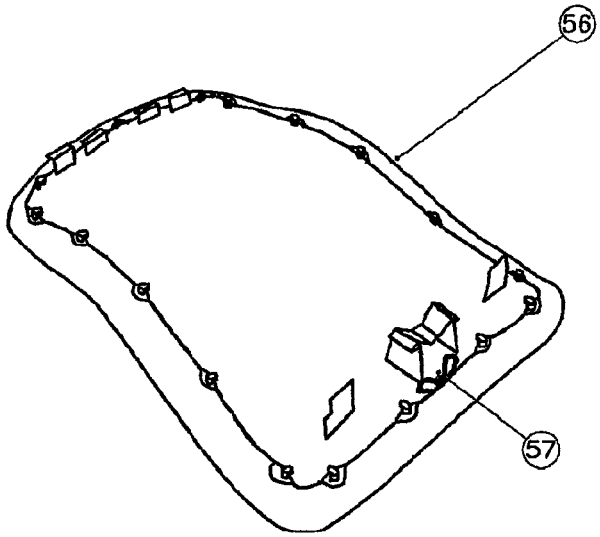
FIG. 11 shows an underneath view of the envelope tightened.

The floor 22 has first lug or lugs 24,24' and a second lug or lugs 25,25'. In a preferred form as shown in FIGS. 3 and 10 there are four such lugs. The first lugs 24,24' are located near the forward end of the base 21, one to each side and the second lugs 25,25' are located near the rearward end, also one to each side. As shown more clearly in FIGS. 4, 5, 7 and 8, each lug 24, 25 has an upwardly and an inwardly directed portion.

The base 21 may also have two pairs of ribs 26,26', one pair extending along each side of the base 21, the ribs extending somewhat upwardly, but normally not to the height of the peripheral skirt 23.

Also, in the base 21 rearwardly of the second or rear lugs 25,25' there is a pair of clip members 27 spaced either side of the central axis of the base 21. The clip members 27 extend upwardly from the base and have an inwardly directed shoulder 28 the operation of which will be described hereinafter.

The inner or member 30, which is upholstered e.g. with padding and fabric or synthetic material but which, for clarity is shown in the figures as un-upholstered, has a plate or base 31, which again may be of a plastics material and which has an external peripheral shape basically corresponding to the floor 22 of the base 21 and is adapted to be received within the skirt of the base.

The padding and upholstery 55 as shown in FIG. 10 is placed on top of the plate 31 and may be effected in a conventional manner.

However, as will be described, by the use of the present invention, we can use what is effectively a removeable cover 56 rather than permanent upholstery.

This is done by forming the outer cover with a draw string 57 or the like and the member 30 is provided with the padding and a cover fitted thereto (shown generally at 55). The final surface fabric can then be located over the member 30 as an envelope 56 and have a skirt which has a peripheral sleeve through which a cord 57 passes (i.e. a draw-string arrangement). This skirt extends below the member 30 and by tightening the cord the fabric can be caused to closely cover the top and side of the member 30. When the member 30 is fitted to the base 21, as described herein, the skirt is between the base 21 and the plate 31, is not visible, and cannot be readily removed by an occupant of the seat. If, however, the cover is damaged or dirtied, it is only necessary for the operator to remove the seat or back member, remove the cover and replace it with another cover and replace the member. This, as will be described, is a very simple operation and could readily be done by a cleaner who finds a damaged or dirtied cover.

This enables the appearance of the seats to be maintained with little expense. Of course, if there is substantial damage, it would be necessary to replace the entire member 30 concerned.

Figure 5:
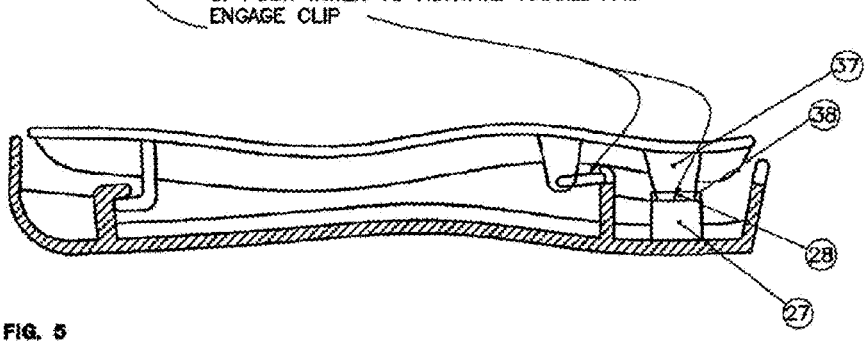
FIG. 5 is a view similar to that of FIG. 4 showing the components inter-engaged.
Figure 6:
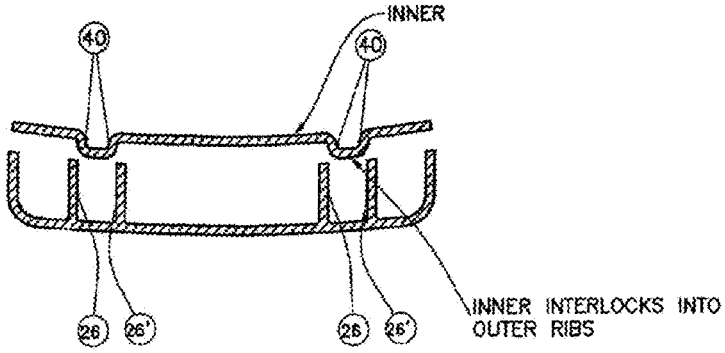
FIG. 6 is a transverse section showing the components when interlocked.

Referring to FIGS. 3, 4, and 5, on the plate 31, and directed downwardly near the forward end thereof, there are a pair of lugs 32 which have both a downwardly and an outwardly directed portion and are adapted to be received under the upwardly and inwardly directed portions of lugs 24,24' of the base 21 previously described.

Towards the rear of the plate 31 there are a pair of downwardly extending lugs 33 to which a first toggle plate 34 may be pivotally attached. The first toggle plate 34 extends transverse of the plate 31 and in use, the first toggle plate 34 extends generally rearward of the downwardly extending lugs 33. When clipped together the first toggle plate 34 engages with the lugs 25,25' on the seat base 21.

The upwardly and inwardly extending lugs 25,25' on the seat base 21 provide a first pivot 35 which receives the 'free' end of the first toggle plate 34. Still referring to FIGS. 3, 4 and 5, to the rear of lugs 33 the plate 31 also has a clip member 36 which can have a pair of clip components or arms 37 each of which have an outwardly directed shoulder 38. As shown in the sectional view of FIG. 9, the two arms 37 are connected by a web 39 of material, the operation of which will be described hereinafter. These arms 37 having shoulders 38 are engageable with the clip members 27 having shoulders 28 on the base 21 as they are resiliently deformable, allowing engagement and disengagement.

The plate 31 also has a pair of downwardly directed ribs 40, one rib extending along each side of the plate 31, each rib 40 being adapted to enter the respective spaces between two pairs of ribs 26,26' upwardly directed from the base 21, one pair of ribs extending along each side of the base, to restrain the plate 31 from lateral movement relative to the base 21 and assist with lateral stability.

In use, the chair can be located in its required position in the venue with the frame 11 mounted in position. Rather than mounting components 20,50 to the frame, the base 21 of either the seat or backrest component 20,50 may be mounted without the inner or member 30.

At this stage, there was little that can be readily damaged by, say, other tradesmen still working on the venue and, should there be damage, it is relatively inexpensive and easy to replace the un-upholstered base 21, which is of sturdier material than upholstery and less vulnerable to stains, cuts or other hazards.

When hazardous or dirty work is completed, installation of the chair 10 may be completed by attaching the upholstered inner or member 30 (having plate 31) to the base 21 (whether of the seat and/or backrest).

The lugs 32 at the forward end of the plate 31 are aligned beneath the inwardly directed portions of the lugs 24,24' on the base 21 as shown in FIG. 4.

The rear end of the plate 31 can start to be rotated downwardly. As the rotation occurs, the downwardly, directed ribs 40 on the plate 31 commence to enter the respective spaces between the ribs 26,26' on the base 21, thus locating the plate 31 laterally relative to the base 21. As the plate 31 is brought further downwardly, the rearward end of the first toggle plate 34 can pass below and contact the lugs 25,25' at the rear of the base 21.

Further downward movement causes the first toggle plate 34 to commence to rotate about its pivot 35 as well as its pivot mount on lugs 33, in a snap-over, or an over-centre action. The clip portions 36 of the plate 31 also commence to engage, by deformation of the arms thereof, the clip members 27 of the base. Downward movement is continued and the first toggle plate 34 snaps to a position, illustrated in FIG. 5, where it is rearwardly and upwardly directed and the shoulders 38 on the clip components 37 of the plate 31 are engaged with the shoulders 28 of the clip components 27 of the base 21.

At this time, the two assemblies are fully interconnected one relative to the other by the interrelationship of the lugs at the forward end, the inter-engagement of the ribs on the underside of the plate with the upstanding ribs of the base, the locking of the first toggle plate beneath the lugs with which it is associated and the clipping together of the clip components.

The first toggle plate 34 is preferably formed to that it causes the plate 31 to be placed in compression and the base 21 in tension and aids in ensuring that there is no unconstrained relative movement within the component. Advantageously this removes 'slop' in the system, reducing the incidence of breakage and providing a 'solid' feel to the system. Hence manufacturing tolerances between various parts are not as critical as they would otherwise be, making mass-production easier.

At the same time, because of the form of the inter-engagement between the base 21 and inner or member 30 it is not simple, prima facie, to remove the plate 31 from the base 21 and thus, destructive vandalism would be minimised or obviated.

The same operation is followed for the seat or backrest, if a chair is to have both seat and backrest according to the embodiment of the invention. When it is required to remove upholstered members from the chair this is basically a simple operation given a required tool and the knowledge of how to do this.

Referring to FIGS. 7 to 9, the tool 51 can be a metal rod or such an article as a screw driver (hereinafter a lever tool) and can be placed through a slot in the rear of the assembly so that it lies beneath the web 39 connecting the two clip portions 37 downwardly extending from the underside of the plate 31 and can abut to brace against the rear of one of the lugs 25 which has received the toggle plate 34.

As the tool 51 is moved upwardly, it can abut the underside of the web 39 which connects the two downwardly directed clip components 37, deforming the web 39 and causing the clip components 37 to move inwardly until they disengage from the clip members 27 of the base 21, the shoulders 28, 38 disengaging and allowing the inner or member 30 to move upwardly relative to the base 21.

The same movement causes the first toggle plate 34 to snap over and become released and ultimately the plate 31 can then be removed simply by moving it rearwardly to disengage the lugs 24 near the front of the base 21 and the plate 31 is then free.

To replace the plate 31 or to return the original seat member 30 to the chair 10, it is only necessary to reverse the initial operation, that is, engage the lugs 32 on the plate 31 with the lugs 24 on the base 21, and cause the plate 31 to rotate which causes the first toggle plate 34 to be actuated and the clip 28,37 to engage. It will be seen that this is a very simple action and can be done by any person with a minimum of training.

The toggle arrangement may include a resilient member which can be located beneath a relatively flat spring member restrained against movement at one end, the spring being moveable to cause compression of the resilient member and to cause operation of the toggle member, the resilient member being adapted to ensure that the spring be normally maintained in the required position.

Whilst herein we have described a chair which meets the desiderata that its upholstery is protected from damage prior to final completion of the venue and can be removed and replaced at any time in a matter of seconds, we still provide a chair which is sturdy, and the base and member of the components are held against relative movement so there is little or no sensation of the seat (or backrest) being of two separate parts, as far as the user is concerned.

FIGS. 14 to 24 show further embodiments of the invention which work in a similar manner to the embodiments described above.

Figure 14:
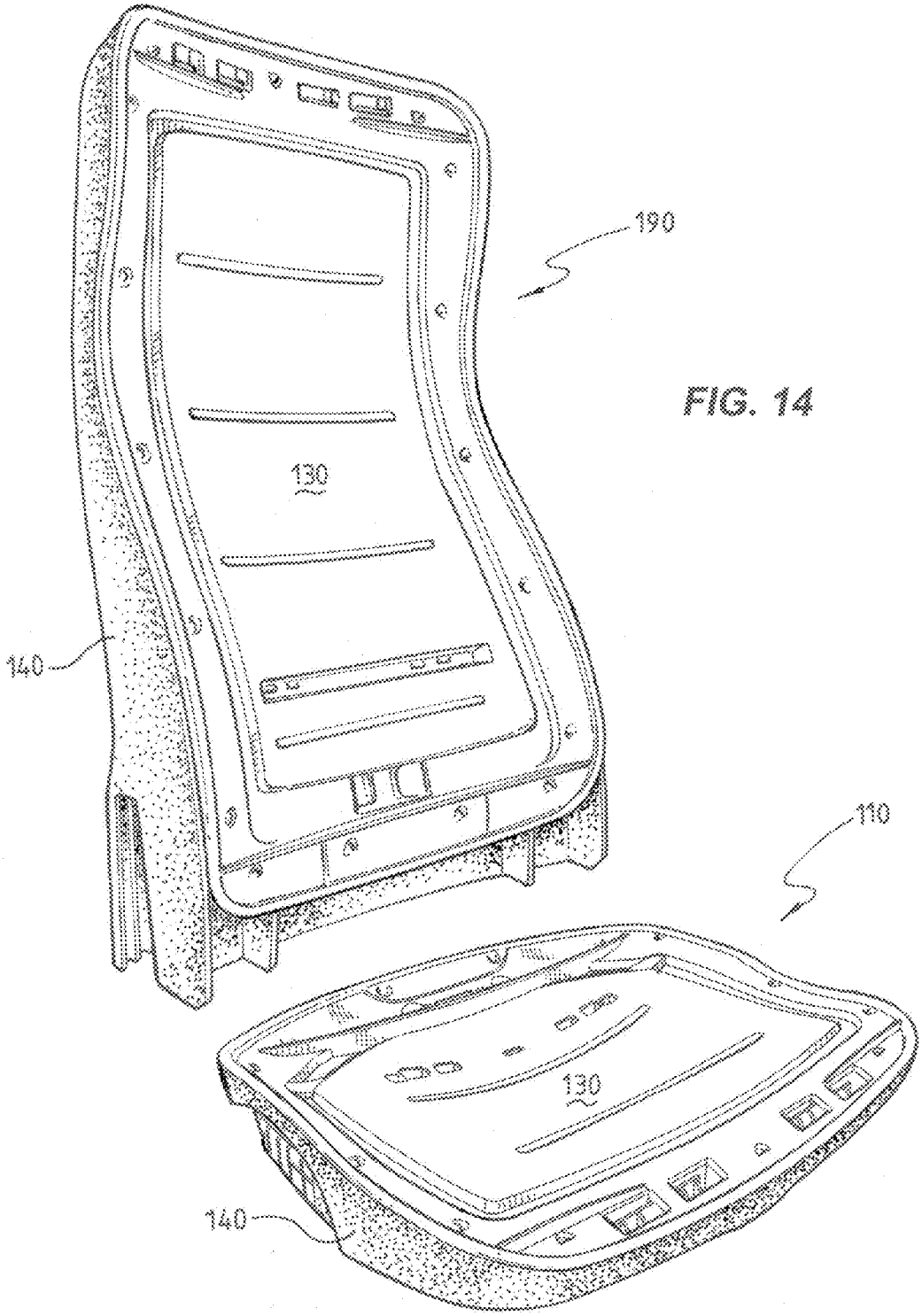
FIG. 14 shows a perspective view of a seat component and a backrest component, not including any upholstery.

FIG. 14 shows a seat component 110 and a backrest component 190, with upholstery and cushions omitted. Each component has a base 140 that when installed is connected to a support (not shown). The seat component 110 and backrest component 190 each have a detachable component member 130. Although the seat component 110 and backrest component 190 have different dimensions that suit their different purposes, functionally the seat component 110 and backrest component 190, and their respective detachable component members 130 and bases 140, operate in the same manner and, functionally, have the same characteristics or features. In FIG. 14, the base 140 and detachable component member 130 are shown in the clipped together or installed position.

Figure 15:
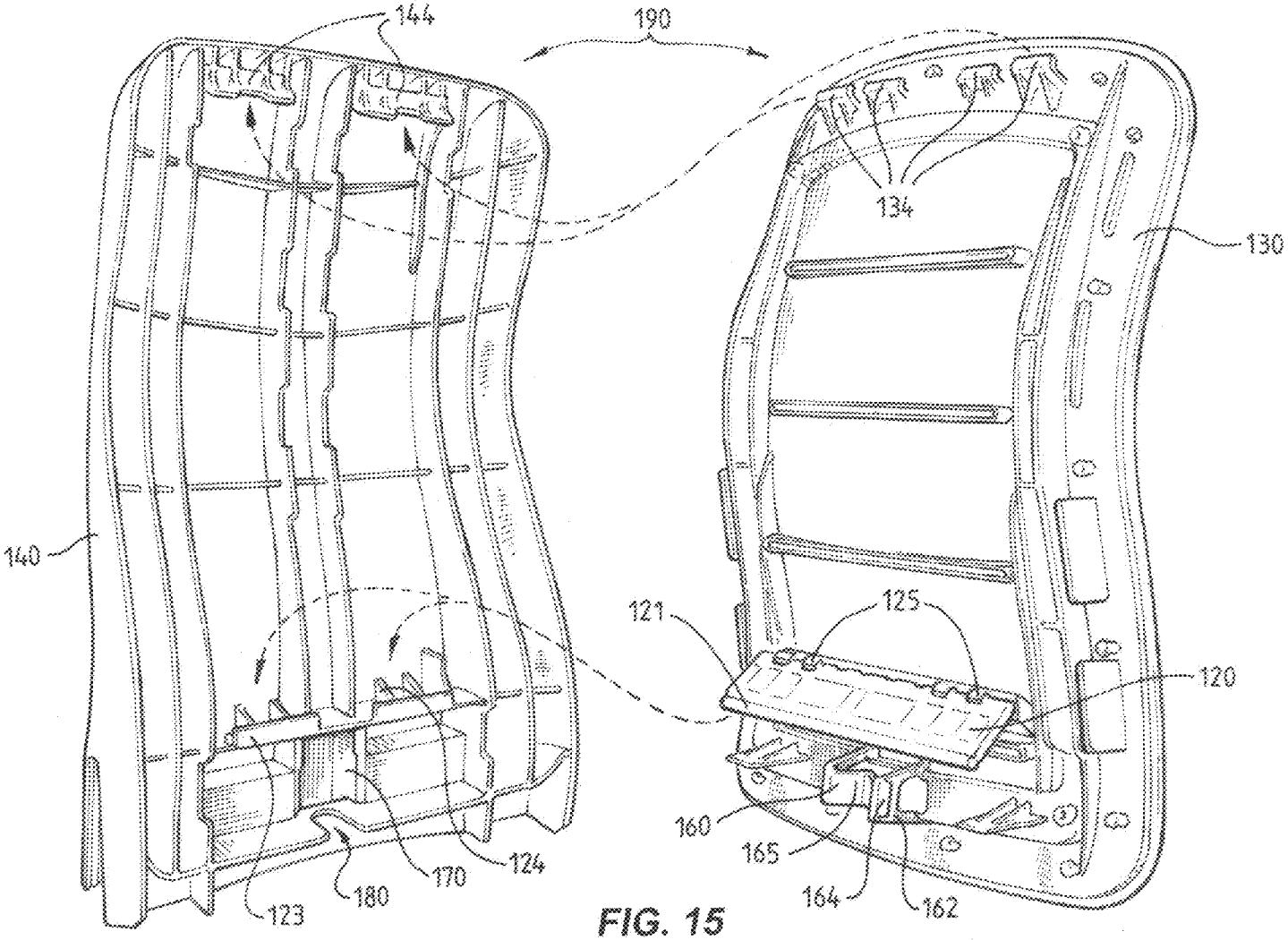
FIG. 15 shows a perspective view of a base and a detachable component member for the backrest component of FIG. 14.

FIG. 15 shows the backrest component 190 of FIG. 14 in exploded view, with the detachable component member 130 shown unclipped from the base 140. The detachable member 130 and base 140 each have part of a complementary brace means 114 and each have part of a complementary clip means 115 which may be viewed in greater detail in FIGS. 19A and 19B.

In the embodiment shown in FIGS. 15, 18A, 18B and 18C, a clip 115 having a first clip portion 160 is provided on the detachable member 130, and a complementary second clip portion 170 is provided on the base 140.

The brace arrangement or means 114 in this embodiment is provided separate from the clip means 115, however, in an alternative embodiment (not shown) an appropriately positioned clip means could also function as the brace means.

The brace arrangement 114 is located at one end of the component 110, comprising a base portion with two base lugs 144 extending from the base 140 and engageable with a detachable member portion with detachable member lugs 134 extending from the detachable component member 130. As shown, a plurality of lugs 134,144 are provided, but single or additional lugs could also function. As shown in FIG. 15A, the base lugs 144 extend in a direction generally inward from an end of the base 140, towards the other end, while the detachable member lugs 134 extend in a direction generally outward from an end of the member 130, away from the other end. The brace arrangement and brace portions may be provided in alternate forms, for example as a flange or posts receivable within one or more recesses or under another flange, or even as an edge of one component restrained from outward movement by an inner surface of the depending outer skirt of the other component. Many functionally equivalent arrangements are possible.

Figure 18A:
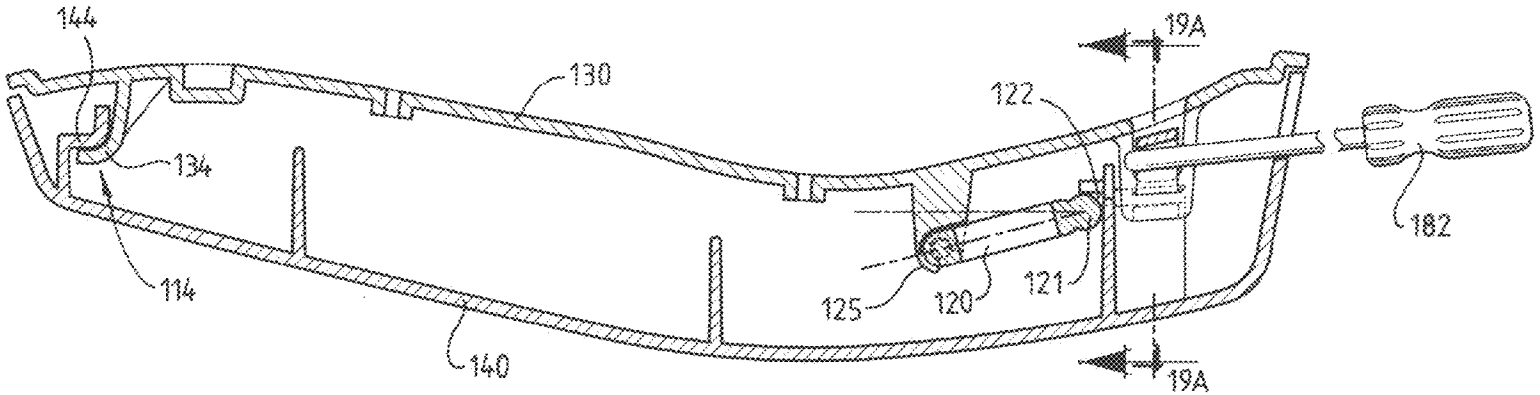
FIGS. 18A to 18C are cross-sectional views of the seat component of FIG. 14, taken at locations shown in FIG. 17.
Figure 18B:
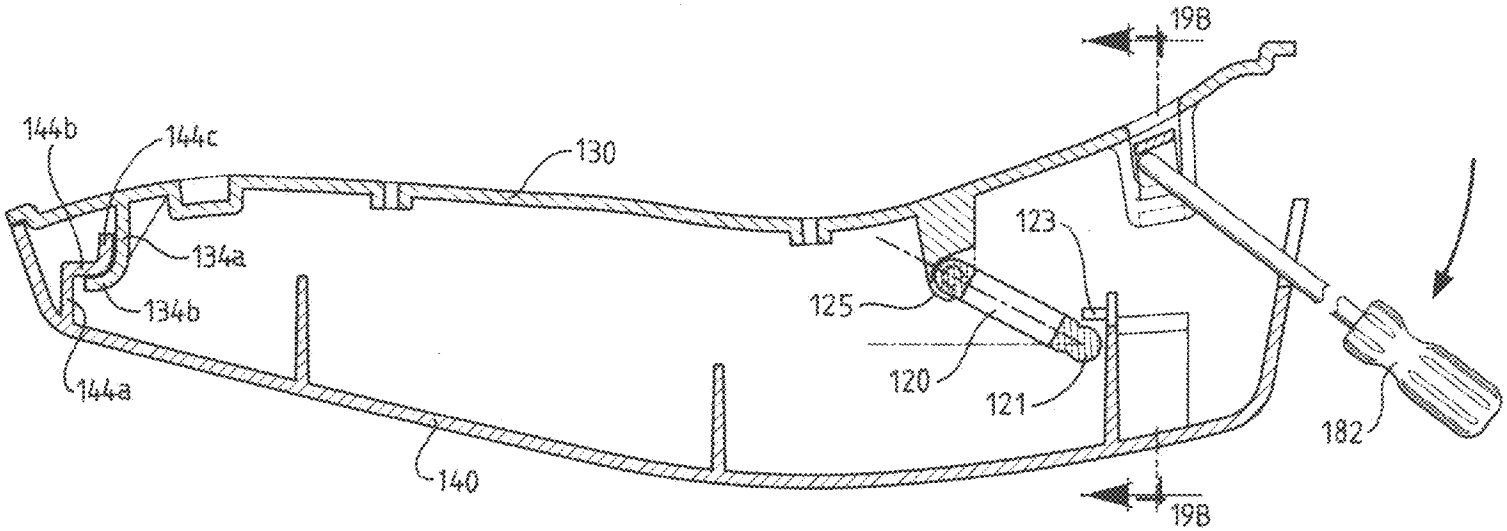

As shown in FIG. 18A the base lug 144 has an upwardly extending portion 144*a* and an inwardly extending portion 144*b*, and a second upwardly extending portion 144*c*. The detachable member lug 134 has a downwardly extending portion 134*a* and an outwardly extending portion 134*b*.

When arranged and braced against each other, the detachable component member 130 is restrained against outward movement (i.e. leftward as shown in FIG. 15A) by the base 140, while the base 140 is restrained against inward movement (i.e. rightward as shown in FIG. 15A) by the detachable member 130. Importantly, a second arrangement with similar effect is provided toward the other end of the component 110 which also restrains the detachable component member from outward movement (i.e., at the other end, rightward as shown in FIG. 15A) and restrains the base 140 against inward movement (i.e., at the other end, leftward as shown in FIG. 15A). This second arrangement is a resilient overcentre or snap over mechanism which, when engaged, puts one of the base and detachable member in compression and the other in tension.

The backrest component 190 has a toggle plate 120 with a free end 121. In the embodiment shown, the toggle plate 120 is hingedly mounted to the detachable member 130 with a hinge 125 and the base 140 has a pivot point 122 (located under a flange 123) (refer FIGS. 18A to 18C) for receiving the free end 121 of the toggle plate 120. Guiding ribs or ramps 124 assist to guide the free end 121 of the toggle plate 120 to the pivot point 122 during installation. Once the brace arrangement is in position and as application of force guides the free end of the toggle plate to the pivot point, further application of force on the detachable component member towards the base member causes the toggle plate to snap overcentre to connect together the two component members.

In other embodiments the arrangement could be reversed, with the toggle plate mounted on the base and the pivot point on the detachable member. In such a case, the brace arrangement 114 would also be reversed such that the two components can still be braced together.

One or more of the base 140, detachable member 130 and toggle plate 120 is made of resilient material such as plastic, or has resilient sections, so that the base 140 and detachable member 130 can be releasably connected, attached or braced to each other in a manner that causes the toggle plate 120 to brace the base 140 and detachable member 130 against each other. The overcentre or "snap over" operation of the toggle plate 120 provides a way of putting one of the base or detachable member into tension, and the other into compression, with the brace arrangement 114 preventing relative movement and holding the base and detachable member in position with each other. Connecting the two component members in this way avoids relative movement between them and gives a user a feeling of solidity, as if the component were of single piece construction.

As shown in FIG. 15, the detachable component member 130 has the first clip portion 160, which has a pair of first clip portion arms 162 between which extends a flexible web 165.

Figures 18C, 19A, 19B:
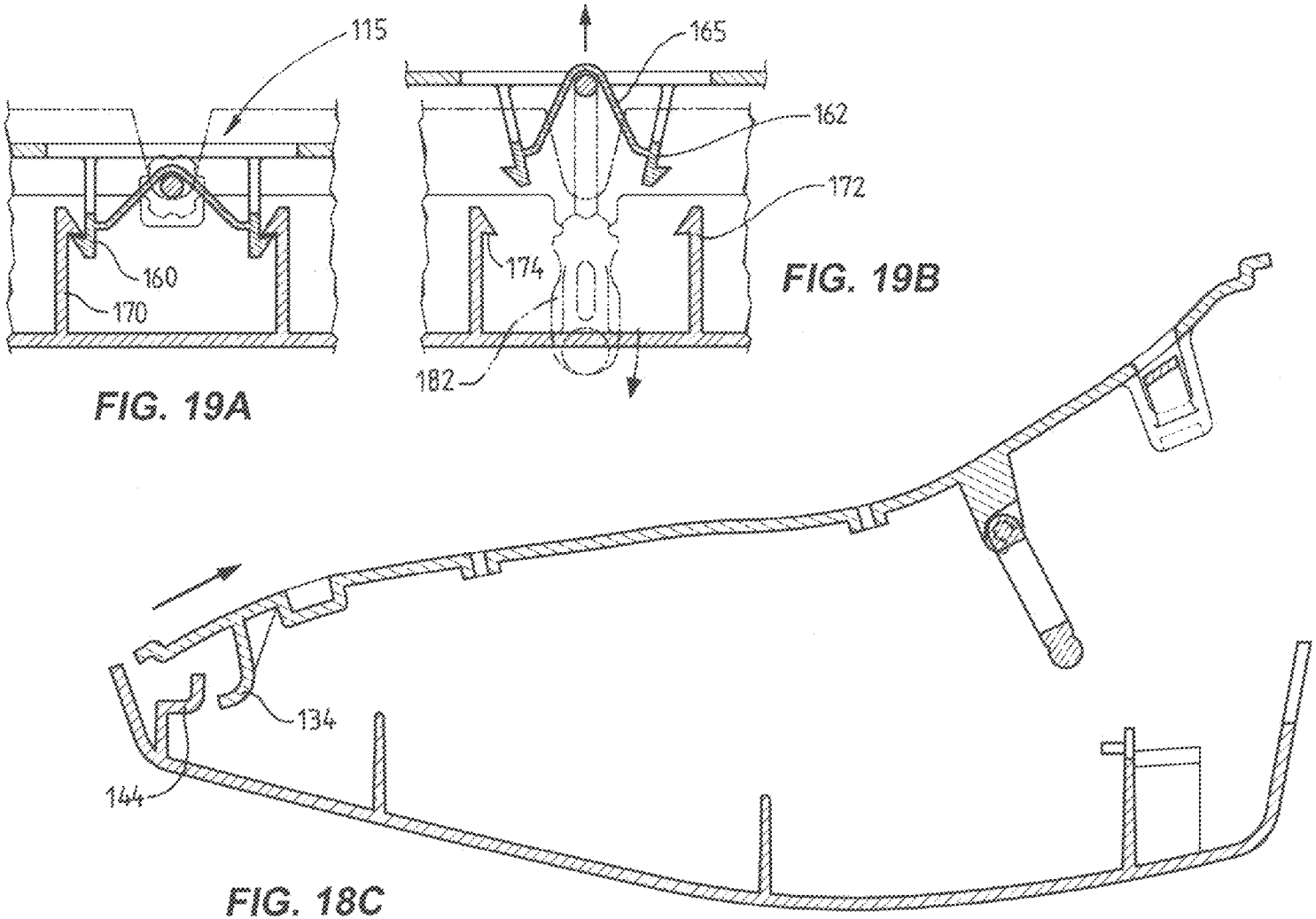
FIGS. 19A and 19B are cross-sectional views of the clip taken at locations shown in FIGS. 18A and 18B.

Deformation of the web 165 causes the first clip portion arms 162 to move toward each other, as shown in FIG. 19B. Each arm 162 has an outwardly directed shoulder 164 which becomes disengaged from the second clip portion 170 when the web 165 is deformed, to release the clip. The second clip portion 170 has a pair of second clip portion arms 172. Each arm 172 has an inwardly directed shoulder 174, the inwardly directed shoulder 174 engageable with the outwardly directed shoulders 164 of the first clip portion to releasably secure the first and second clip portions together.

In use, a user deforms the flexible web 165, preferably using a lever tool 182 such as a screwdriver, to disengage the clip and allow the detachable component member 130 to be detached from the base 140.

Alternative clipping arrangements are possible, for example by providing the first clip portion 160 with web 165 on the base 140 instead of on the detachable component member 130, and the second clip portion on the detachable member 130. Other types of clips can also be used, for example where a user squeezes together two clip arms to release the clip, or flexes a single clip member to release it from a recess or protrusion, but the embodiment shown is desirable from a security perspective.

Provision of a clip, recessed inside the component, is a security feature that advantageously prevents the general public from easily removing a detachable component member from its base, as could otherwise occur. Alternative security features to detachably retain the detachable component member upon the base such as locks could also but less conveniently be used. The web clip described is advantageously recessed inside the component and requires a simple (but not commonly carried by the public) tool to be released. A further advantage is that use of the lever tool as described also results in operation of the overcentre or snap over toggle plate to disengage the components from each other, in the same action as releasing the clip.

Figure 16:
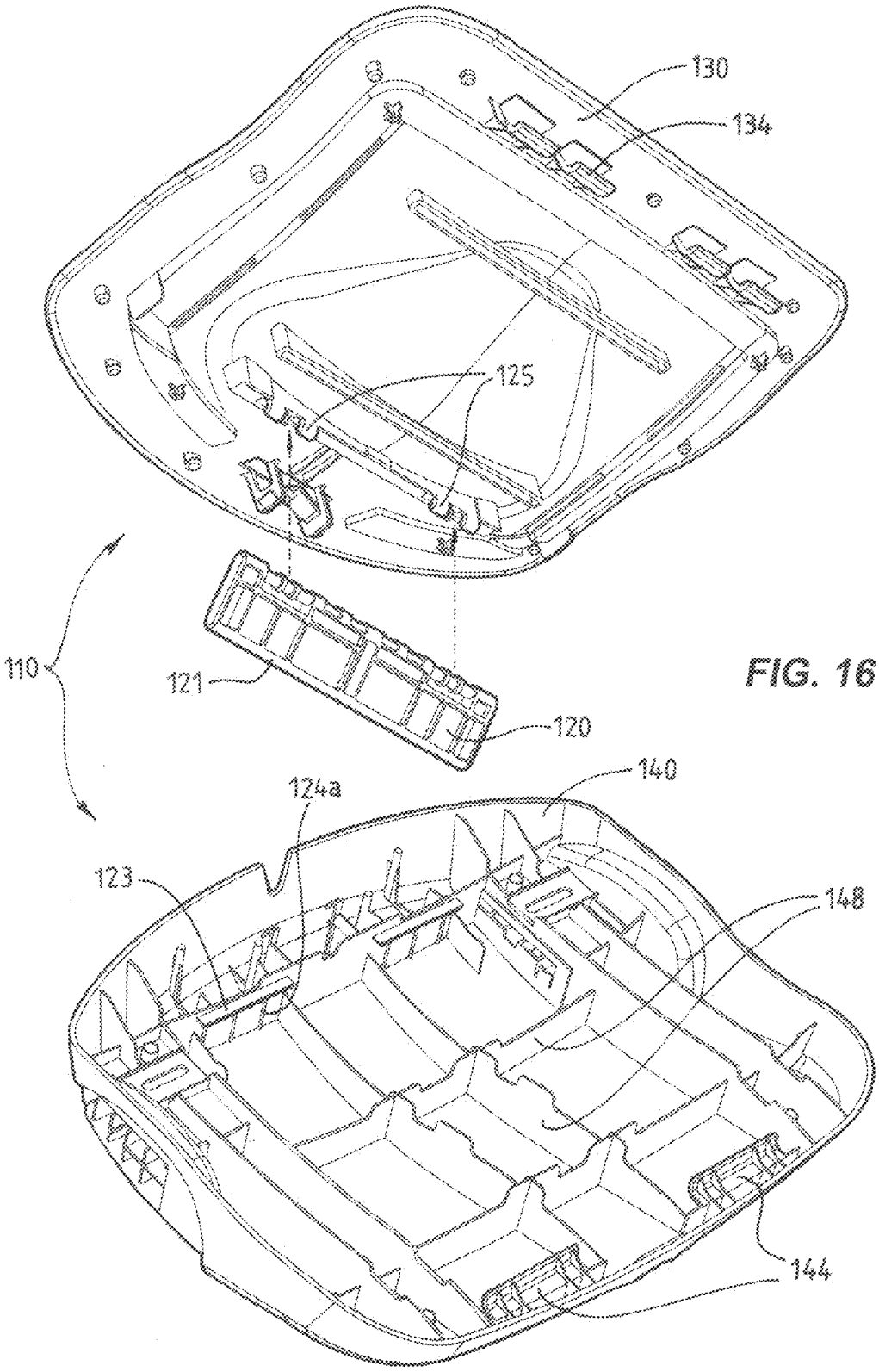
FIG. 16 shows a perspective view of a base and a detachable component member (with toggle plate in exploded view) for the seat component of FIG. 14.

FIG. 16 shows the seat component 110 of FIG. 14, in exploded view, having a base 140, detachable component member 130 and a toggle plate 120. When fitted together in non-exploded form, the toggle plate 120 is received and held at hinges 125 as indicated by arrows.

Functionally, the seat component 110 is braced and clipped together in the same manner as the backrest component 190 of FIG. 15, although in this embodiment, the guide ramps adjacent the pivot point under flange 123 are omitted and instead linear rails 124*a* are provided, which still act to assist in more easily locating the free end 121 of the toggle plate 120 at the pivot point.

Figure 17:
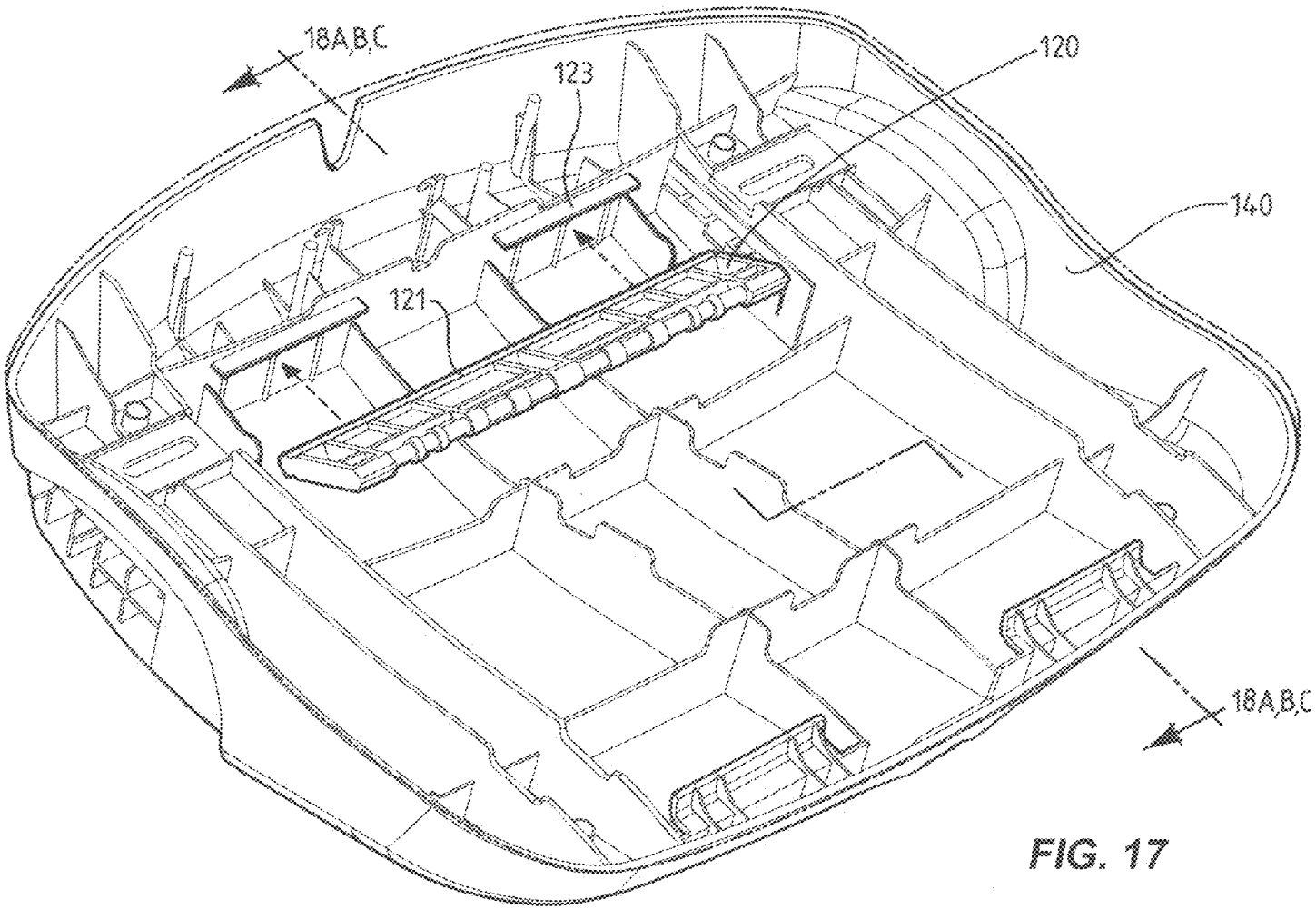
FIG. 17 shows a perspective view of the seat base of FIG. 16 together with the toggle plate from the seat detachable component member.

FIG. 17 shows the base 140 of seat component 110 of FIG. 16. Also shown in toggle plate 120, (but without detachable member 130 to which the toggle plate would be hingedly connected). Arrows show the direction in which the free end 121 is moved to be received under the flange 123 at the pivot point.

Figure 20:
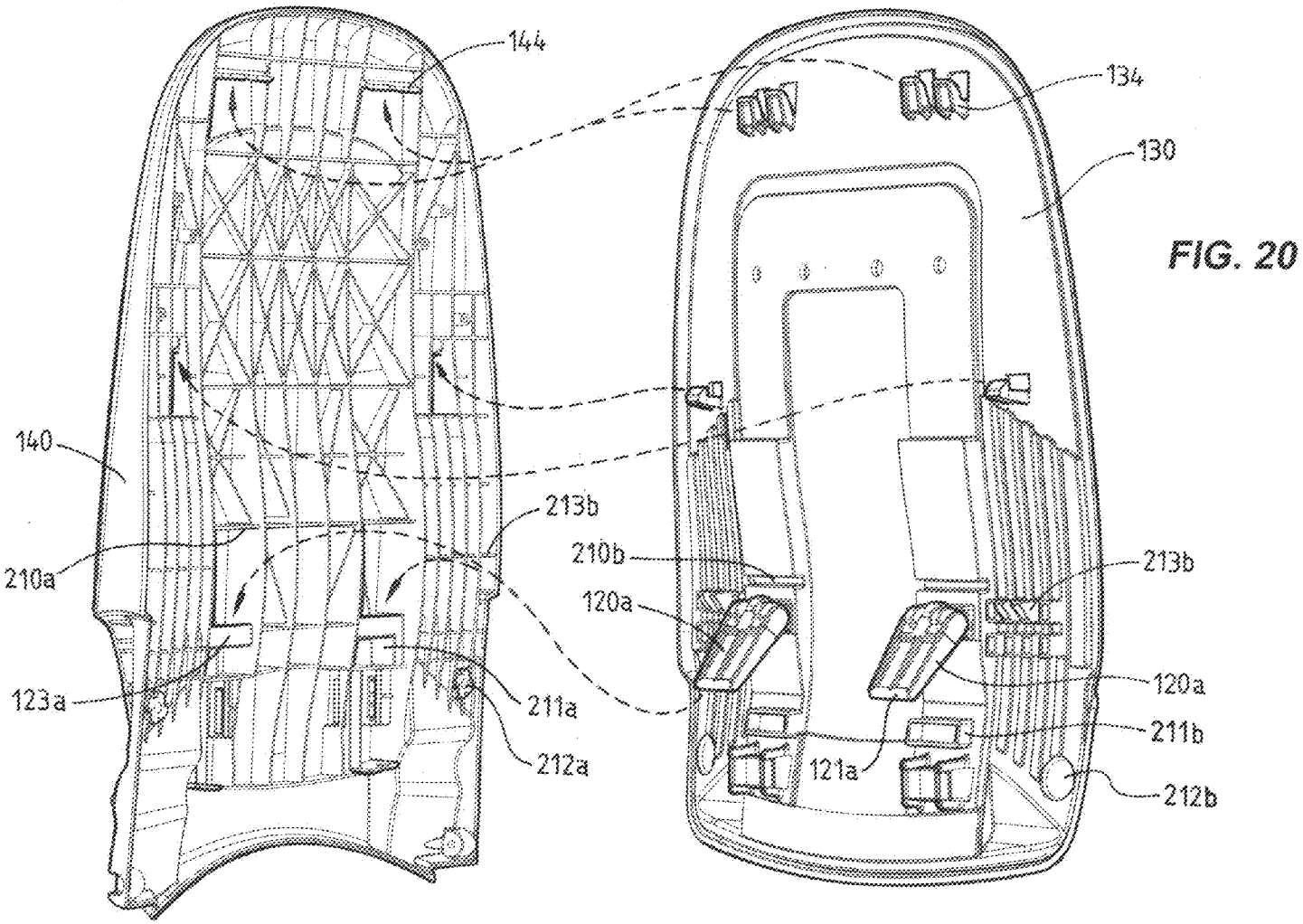
FIG. 20 shows a perspective view of an alternative base and detachable member for a backrest component.

FIG. 20 shows an alternative embodiment of a backrest component comprising a base 140 and a detachable component member 130. FIG. 21 shows a similar seat component.

Strength of the components and respective base and detachable member is important to ensure the components when used are sturdy enough for public use in venues such as stadiums and arenas, where the components will be subject to significant wear and tear, potentially with people standing on and climbing over the chairs etc. Thus, the components include many strengthening ribs which are arranged to provide additional strength in areas such as the side edges where loads could be concentrated, as well as across central areas. Many of the ribs (and other strengthening features such as recesses and bosses) are arranged for complementary engagement or positioning with complementary features on the other component member. Thus, paired features 210*a*, 210*b*, 211*a*, 211*b*, 212*a*, 212*b*, 213*a*, 213*b* are provided to both correctly locate and position the component members, and to contribute to the overall strength of the component.

Typically, a seat base or bracket is somewhat concave, having greater depth in the central region than at the sides. As can be seen on the backrest detachable component member 130 of FIG. 15, the detachable member 130 is also somewhat concave, as can also be seen in FIGS. 18A to 18C. This provides a somewhat "sprung" effect that increases the user's comfort. However, the height of some stiffening ribs, when a toggle plate as previously described is provided on the concave detachable member can cause problems in the deeper central area of the component base. For example, central ribs 148 as shown in the seat base of FIG. 16 support the concave detachable member, providing a sprung effect that retains strength and rigidity, but results in the overall thickness or depth of the seat being too great in some circumstances. It is often desirable to provide slim-line seats that, when folded up around a hinge point, allow easy access by the public, for example in a stadium. Thus, people can easily walk by unoccupied seats. Thus, a seat as shown in FIG. 21 may be provided with a greater number of ribs having less height to produce similar strength and rigidity. It is also often desirable for a seat or backrest to be beam mounted on a beam. In such a base the beam is continuous and extends laterally of the component, with many chairs mounted thereon. To maximise user space or prevent seats needing to be spaced further apart, it is again desirable that backrest components are also slim-line or even that the laterally extending beam partially passes through the base.

In both the above circumstances, to avoid a component becoming too thick or high, additional ribbing is provided but of lower height or profile and overall concavity of the base is reduced or flattened. Unfortunately this results in problems with the full width toggle plate of FIGS. 15 and 16 as it is mounted on the concave detachable member. There is insufficient clearance through the central area for operation of the toggle plate unless the height of the central ribs is even further reduced, which impacts on the user's comfort.

An excellent solution is to provide two separate toggle plates, one on each side, while the centre area is free and thus maximum height ribs can be provided across the centre of the base component and the detachable member can remain concave. Thus as shown in FIGS. 20 and 21, two toggle plates 120*a* are provided on component member 130 either side of the centre, each having a free end 121*a*. Likewise two flanges 123*a* are provided on the base 140 either side of the centre with two pivot points underneath. Two pairs of associated guide ramps 124*a* are also provided.

Two web clips 160*a* with the first clip portion arms 162*a* and flexible web 165*a* are also provided either side of the centre of detachable member 130. Base 140 has a second clip portion 170*a* and two access holes 180*a* for insertion of a lever tool (preferably for simultaneous insertion of two lever tools).

A further difference between the embodiment of FIGS. 20 and 21, and the embodiment of FIGS. 15 and 16, is additional clip members 250 which depend from the detachable member 130 to engage through a hole 255 in the base 140. One clip member is provided either side of the member 130. These assist in aligning the component members during installation and provide additional clipping strength. They are easily released by rotation of the detachable member 130 as is shown in FIGS. 24A and 24B.

Figure 22:
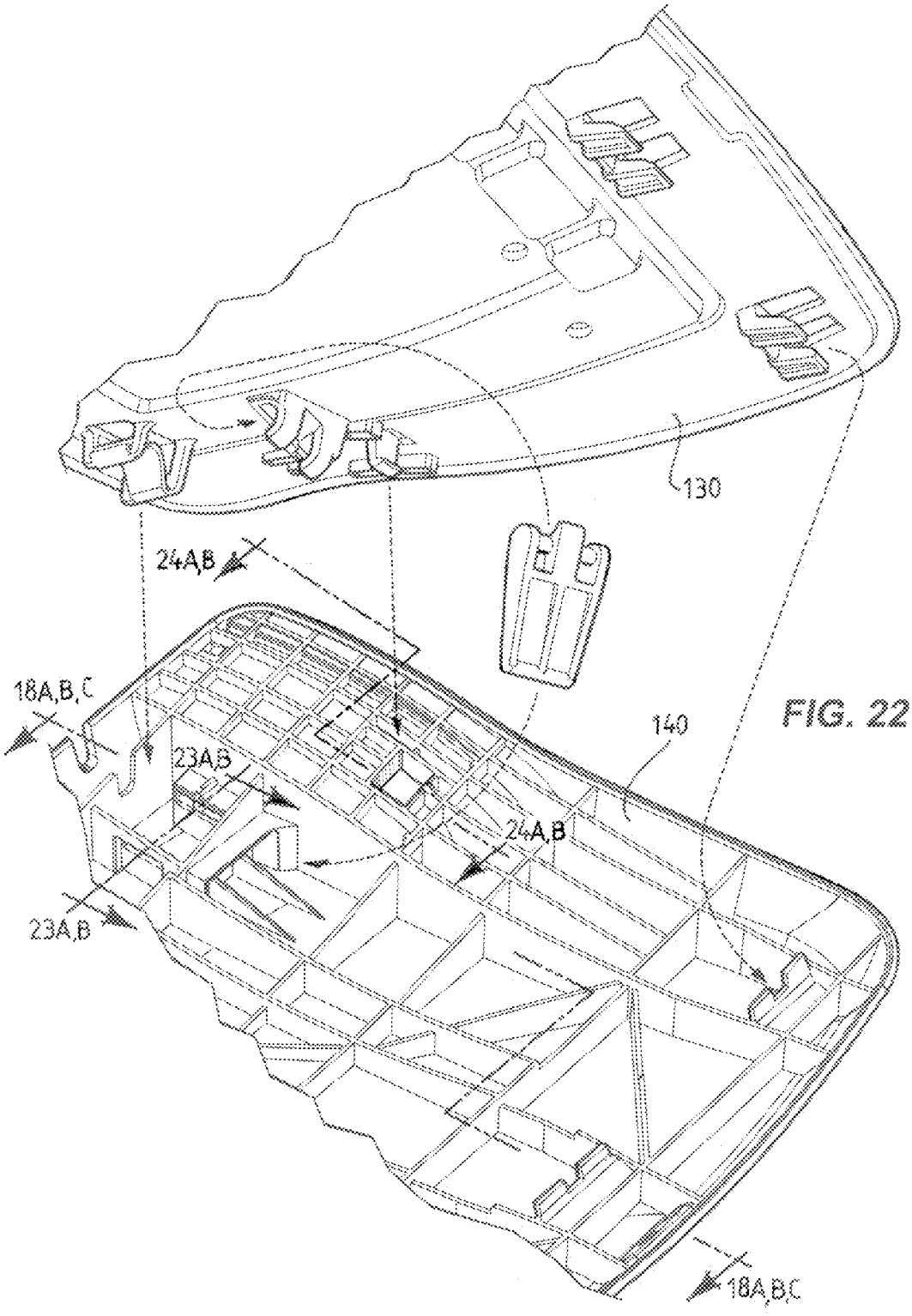
FIG. 22 shows a partial exploded view of the component of FIG. 21.
Figure 23A:
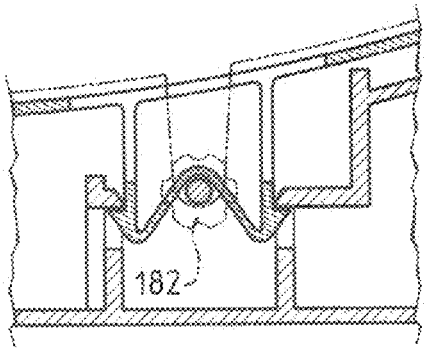
FIGS. 23A and 23B are cross-sectional views of the clip, taken at a location shown in FIG. 22.
Figure 23B:
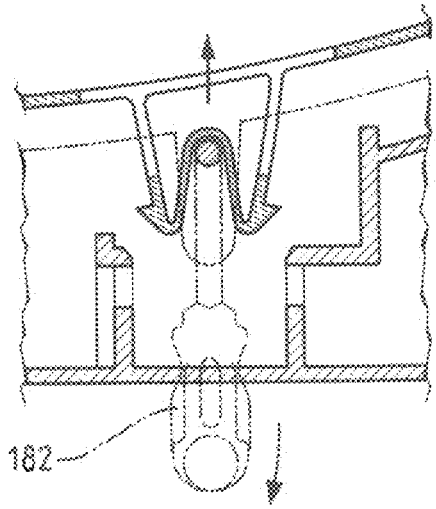

FIG. 22 shows the embodiment of FIG. 20 in greater detail and FIGS. 23A and 23B show operation of the web clip in greater detail.

Figure 24A:
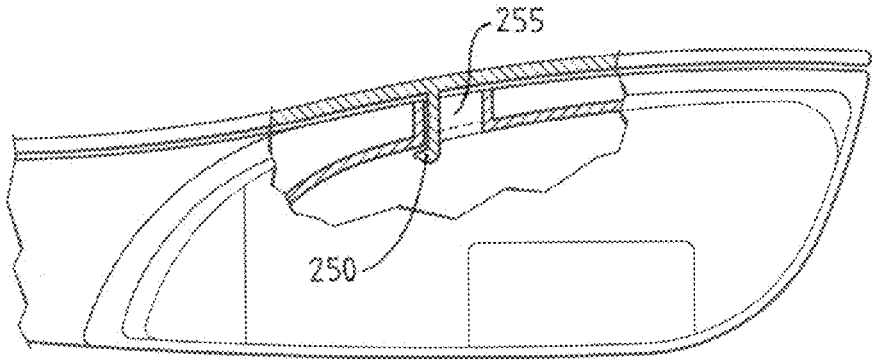
FIGS. 24A and 24B are cross-sectional views taken at a location shown in FIG. 22.
Figure 24B:
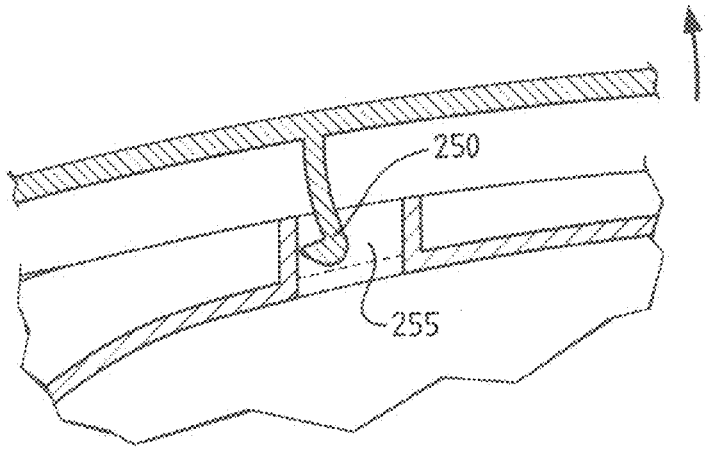

FIGS. 24A and 24B show the additional clip means 250 in cross-section, in an inserted position and flexed as it is unclipped.

The seat of the present invention may also be adapted to be used with seats of different widths.

Some venues are designed to have seats at greater or lesser spacing and in some, it is required to provide different seats having different spacings. This could be the case where seats which are sold at a more expensive price may be at a wider spacing than those at cheaper prices. Not unusually, the spacing required vary between 22 to 24 inches. It is most inconvenient for a manufacturer or a theatre operator to have to hold components of different sizes for different parts of a particular theatre.

Figure 12:
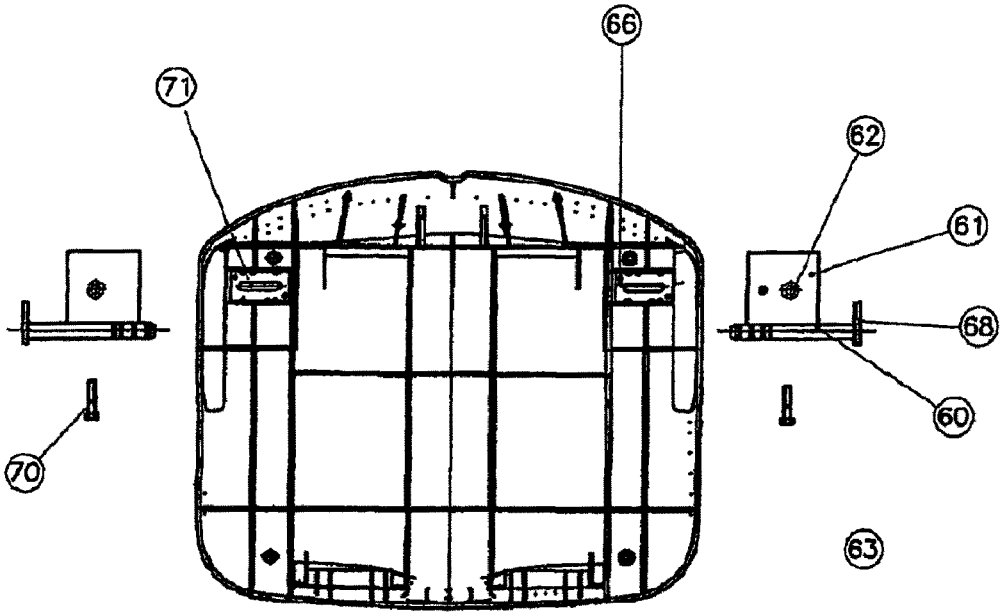
FIG. 12 shows the underside of the seat with, exploded therefrom the mounting pivot whereby the seat can be used for various widths.
Figure 13:
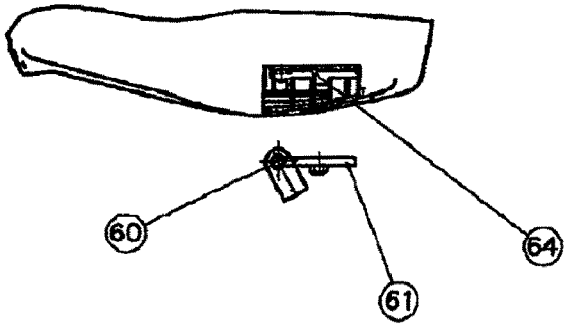
FIG. 13 shows a side view of the arrangement of FIG. 10.

As shown in FIGS. 12 and 13, we provide on the underside of the base 22 an arrangement where the pivot shafts 60 of the seat can be located at various spacing in the seat. We provide, attached to the pivot shaft a flat plate 61 which has an aperture 62 therethrough which has on its underside, a cone-nut. In the side of the base a slot 64 which can receive the shaft 60 and plate 61.

In the base we provide a recess which is adapted to have a tension plate 66 located therein, the slot preferably having undercuts or the like so that the plate 66 is retained once it is fitted.

When the base is to be connected to the frame, the shaft members 60 and plated 62 are located in the slot 64 so that the outer end of the pivot shaft extends from the base by an amount sufficient to permit it to be connected to the pivot journal. A stud or bolt 70 is then passed through the elongated slot 71 in the plate 66 and the aperture 62 in the plate 61 and threaded onto the cone nut so that the shaft assembly is fixed relative to the base.

In this way, it is possible to use the same seat component (and backrest component) for seats on which the arm-rests are at varying distances to give an impression of a more comfortable or economy seat, depending on the type required. It would be possible to provide better upholstery on the seat components which are at greater spacing.

Whilst the illustrated embodiment shows only a single pivot, which would be used with a weighted seat, more complex arrangements could be provided if required.

If the seat is to be moveable, then stop members can be provided to limit the movement of the seat rearwardly, and a member on the frame can be contacted by an extension 68 on the end of the pivot shaft. so that it does not rest against the back member, and there may also be buffer means to control the rate of rearward movement.

Also whilst we have described one particular method of construction, it will be understood that any person seeing this particular method could well understand how to make variations in this without departing form the spirit and scope of the invention

The invention claimed is:

1. A chair comprised of:

a frame;

at least one of a seat component and backrest component, the seat component and backrest component having a base member and a detachable member;

the base member connected to said frame;

complementary clip means on the base member to cooperate with the detachable member, whereby the detachable member can be clipped to the base member; and a toggle joint comprising one of the base member and the detachable member having a pivot portion and a first brace portion spaced apart from each other by a first distance and the other of the base and the detachable member having a pivotally mounted first toggle plate, having a pivotally mounted end and a free end and the toggle plate having a toggle plate length between the pivotally mounted end and the free end, and a second brace portion, the first distance being greater than the distance between the pivotally mounted end of the first toggle plate and the second brace portion and less than the distance between the pivotally mounted end of the first toggle plate plus the toggle plate;

wherein the base and the detachable member may be releasably connected by arranging the first brace portion against the second brace portion and by positioning of the free end of the first toggle plate in to the first pivot point and snapping the base and detachable component member together such that the toggle plate pivots around the first pivot point at the free end, putting one of the base and the detachable member under tension and the other of the base and the detachable member under compression.

2. The chair as claimed in claim 1 wherein said complementary clip means comprise:

a first set of spaced arms on the base member, said first set of spaced arms having shoulders thereon and a flexible web therebetween; and a second set of spaced aims on the seat or backrest member, said second set of spaced arms having complementary shoulders thereon, the shoulders of the first set of arms capable of being received by the complementary shoulders of the second set of arms whereby the base member and seat or backrest member can be clipped together and the flexible web is capable of being deformed so as to cause the first set of arms to move together to thereby release the shoulders of the first set of arms from the complementary shoulders of the second set of arms.

3. The chair as claimed in claim 2 wherein access means are provided to permit access to the web by a tool which can be used as a lever to effect the deformation of the web.

4. The chair as claimed in claim 1 wherein there are complementary lugs on the seat and/or backrest member and the or each respective base member whereby the two members can be initially located one relative to the other before the clipping is effected.

5. The chair as claimed in claim 1 wherein there are complementary ribs on the seat and/or backrest member and the or each respective base member, the complementary ribs engageable during the clipping operation to provide lateral stability of the component.

6. The chair as claimed in claim 1 wherein the one of the seat member and backrest member has an upholstered surface and includes an outer cover which can fit over the upholstered surface and extends therebeneath, the arrangement being such that the cover portion which extends therebeneath is located between the component base member and the seat and/or backrest member when assembled.

7. The chair as claimed in claim 6 wherein the outer cover has a drawstring about its periphery to effectively locate and hold the cover over the seat and/or backrest member.

8. A chair having a support, and at least one of a seat component and a backrest component connected to the support, the component comprising:

a base connected to the support;

a detachable member;

a brace arrangement comprising one of the base and the detachable member having a pivot portion and a first brace portion spaced apart from each other by a first distance and the other of the base and the detachable member having a pivotally mounted first toggle plate, having a pivotally mounted end and a free end and the toggle plate having a toggle plate length between the pivotally mounted end and the free end, and a second brace portion, the first distance being greater than the distance between the pivotally mounted end of the first toggle plate and the second brace portion and less than the distance between the pivotally mounted end of the first toggle plate plus the toggle plate;

wherein the base and the detachable member may be releasably connected by arranging the first brace portion against the second brace portion and positioning of the free end of the first toggle plate in to the first pivot point and snapping the base and detachable component member together such that the toggle plate pivots around the first pivot point at the free end, putting one of the base and the detachable member under tension and the other of the base and the detachable member under compression.

9. A chair according to claim 8, further comprising a clip for releasably attaching the detachable member to the base, the clip having a first clip portion and a complementary second clip portion for receiving the first clip portion, one of the base and the detachable member having the first clip portion and the other of the base and the detachable member having the second clip portion.

10. A chair according to claim 9 wherein the first clip portion comprises a pair of first clip portion arms with a flexible web therebetween; whereby deformation of the flexible web causes the first clip portion arms to move toward each other, thereby releasing the clip to allow detaching of the detachable member from the base.

11. A chair according to claim 10 wherein the second clip portion comprises a pair of second clip portion arms and each of the second clip portion arms has an inwardly directed shoulder and wherein each of the first clip portion arms has an outwardly directed shoulder, said inwardly and outwardly directed shoulders being engageable to releasably attach the first clip portion to the second clip portion.

12. A chair according to claim 8 wherein the detachable member has the first toggle plate and the base member has the pivot portion.

13. A chair according to claim 8, wherein the base or the detachable member having the pivotally mounted first toggle plate also comprises a pivotally mounted second toggle plate, having a pivotally mounted end and a free end, and the other of the base or the detachable member having a second pivot point spaced apart from the first brace portion by a second distance for receiving the free end of the second toggle plate;

wherein the pivotally mounted second toggle plate is arranged at the same distance from the second brace portion as the fist toggle plate and the second pivot portion arranged at the same distance from the first.

14. A chair according to claim 13 further including access means permitting access to the flexible web by a lever tool, wherein the lever tool may be used to deform the flexible web.

15. A chair according to claim 8 wherein the detachable member includes a pair of downwardly directed ribs, one downward rib extending along each side of the detachable member and wherein the base includes two pairs of upwardly directed ribs, one pair of upward ribs extending along each side of the base, wherein each downward rib is received between respective upward ribs when the base and detachable member are attached to each other.

16. A chair according to claim 8 wherein the base includes a base lug having an upwardly and an inwardly directed portion and the detachable member includes a member lug having a downwardly and an outwardly directed portion, the member lug adapted to be received under the base lug.

17. A chair according to claim 8 wherein the first toggle plate is resilient.

18. A chair according to claim 8 wherein the first toggle plate is spring mounted.

19. A chair according to claim 8 wherein the detachable member is upholstered with an outer layer that extends over at least a portion of each face of the member.

20. A chair according to claim 8 wherein the outer layer is a cover having a peripheral drawstring.

21. A chair according to claim 8 wherein the support is a beam.

22. A component for use in a chair the component comprising:

a base;

a detachable component member;

a brace arrangement comprising one of the base and the detachable member having a pivot portion and a first brace portion spaced apart from each other by a first distance and the other of the base and the detachable component member having a pivotally mounted toggle plate, having a pivotally mounted end and a free end and the toggle plate having a toggle plate length between the pivotally mounted end and the free end, and a second brace portion, the first distance being greater than the distance between the pivotally mounted end of the toggle plate and the second brace portion and less than the distance between the pivotally mounted end of the toggle plate plus the toggle plate;

wherein the base and the detachable component member may be releasably connected by arranging the first brace portion against the second brace portion and by positioning of the free end of the toggle plate in to the first pivot point and snapping the base and detachable component member together such that the toggle plate pivots around the first pivot point at the free end, putting one of the base and the detachable member under tension and the other of the base and the detachable member under compression.

23. A component, for use in a chair, according to claim 22, further comprising a clip for releasably attaching the detachable member to the base, the clip having a first clip portion and a complementary second clip portion for receiving the first clip portion, one of the base and the detachable member having the first clip portion and the other of the base and the detachable member having the second clip portion.

24. A detachable component member for attaching to a base member suitable for use in a chair, the base member having a pivot portion and a first brace base portion spaced apart from each other by a first distance the detachable member comprising:

a pivotally mounted toggle plate, having a pivotally mounted end and a free end and the toggle plate having a toggle plate length between the pivotally mounted end and the free end a second brace portion, the first distance being greater than the distance between the pivotally mounted end of the toggle plate and the second brace portion and less than the distance between the pivotally mounted end of the toggle plate plus the toggle plate; and a first clip portion having a pair of first clip portion arms with a flexible web therebetween; whereby deformation of the flexible web causes the first clip portion arms to move toward each other, to thereby allow release of a clip means to allow detaching of the member from a base, wherein the base and the detachable component member may be releasably connected by arranging the first brace portion against the second brace portion and by positioning of the free end of the toggle plate in to the first pivot point and snapping the base and detachable component member together such that the toggle plate pivots around the first pivot point at the free end, putting one of the base and the detachable member under tension and the other of the base and the detachable member under compression.

* * * * *